US009580895B2

(12) United States Patent
Xu et al.

(10) Patent No.: US 9,580,895 B2
(45) Date of Patent: Feb. 28, 2017

(54) DRAINING AND FLUSHING MECHANISM

(71) Applicant: Feiyu Li, Xiamen (CN)

(72) Inventors: Haitao Xu, Xiamen (CN); Aimin Wu, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 272 days.

(21) Appl. No.: 14/402,981

(22) PCT Filed: Apr. 28, 2013

(86) PCT No.: PCT/CN2013/074982
§ 371 (c)(1),
(2) Date: Nov. 21, 2014

(87) PCT Pub. No.: WO2013/174197
PCT Pub. Date: Nov. 28, 2013

(65) Prior Publication Data

US 2015/0159357 A1 Jun. 11, 2015

(30) Foreign Application Priority Data

May 23, 2012 (CN) ..... 2012 1 0163595

(51) Int. Cl.
*E03D 1/24* (2006.01)
*E03D 3/04* (2006.01)

(52) U.S. Cl.
CPC ..... *E03D 3/04* (2013.01); *Y10T 137/7287* (2015.04)

(58) Field of Classification Search
CPC ..... E03D 1/286; E03D 3/10
USPC ..... 4/329, 332, 334, 354
See application file for complete search history.

(56) References Cited

U.S. PATENT DOCUMENTS 6,219,855 B1 * 4/2001 Hsu ..... E03D 3/10 4/354
8,332,970 B2 * 12/2012 Li ..... E03D 3/10 4/354
2003/0145370 A1 * 8/2003 Lee ..... E03D 3/10 4/354
2010/0212746 A1 8/2010 Maercovich

FOREIGN PATENT DOCUMENTS

CN 2719948 Y 8/2005
CN 2883520 Y 3/2007
CN 201137195 Y 10/2008
(Continued)

*Primary Examiner* — Huyen Le
(74) *Attorney, Agent, or Firm* — Rabin & Berdo, P.C.

(57) ABSTRACT

A draining and flushing mechanism comprises a tank body, a first piston, a fixation rod to assemble the first piston, a main energy-storage spring and a drainage valve; the first piston is assembled inside the tank body and divided the tank body into a top tank and a bottom tank; the bottom tank is a water storage room spaced by the first piston and the tank body at the lower portion of the tank body; the main energy-storage spring is attached to the first piston to push the first piston to the bottom tank; an inlet pipe is connected to the bottom tank; wherein the bottom surface of the bottom tank is disposed with an assembly hole, the drainage valve is connected to the assembly hole and assembled to the outer side of the bottom tank, the drainage valve is disposed with at least a drainage hole.

13 Claims, 7 Drawing Sheets

(56) References Cited

FOREIGN PATENT DOCUMENTS

| | | | |
|---|---|---|---|
| CN | 201420294 | Y | 3/2010 |
| CN | 101892696 | A | 11/2010 |
| CN | 102808440 | A | 12/2012 |
| WO | WO-9842926 | A1 | 10/1998 |

* cited by examiner

DRAINING AND FLUSHING MECHANISM

FIELD OF THE INVENTION

The present invention relates to a draining mechanism, especially to a draining and flushing mechanism applied in bathroom accessory like toilets to drain water out and flush the toilet.

BACKGROUND OF THE INVENTION

To reduce the size of the toilet and make the toilet with more attractive appearance, and on the basic of the performance, the small size of toilet must have strong flushing ability.

A flushing mechanism is disclosed in the Chinese patent database with patent number ZL201010252463.9, the flushing mechanism comprises a tank body; an axis with an outlet is configured at the tank bottom; a guiding rod fixed with respect to the tank body axially along the axis; a first piston closely slidable along the axis on the column inner surface and the guiding rod; a load spring of the first piston sleeved on the guiding rod and assembled to the upper cavity; a second piston closely slidable along the axis in the guiding rod, the second piston is disposed between the first piston and the tank bottom; a load spring of the second piston sleeved on the guiding rod; a control valve; the lower end of the first piston is disposed with an annular raising, when the first piston slides down, the annular raising makes the big sealing of the sealing component of the second piston bended and transformed, the big sealing of the sealing component of the second piston is transformed prior to the small sealing of the sealing component of the second piston, so that water in the annular external lower cavity drains out.

With above structure, although the needed effect can be implemented, it calls high demands to the components of the drain valve and the assembly position, the structure size is large, and the assembly and maintain are complicated. Therefore, it limits the design of the flushing system and the toilet.

SUMMARY OF THE INVENTION

The object of the present invention is to overcome the disadvantages of the existing technology, the present invention is provided with a draining and flushing mechanism that it is not strictly required in the size of the flushing mechanism and the position, it realizes personality and miniaturization of the whole toilet and other bathroom accessories, and it is more convenient to assemble and maintain every components.

The technical proposal of the present invention is that:

A draining and flushing mechanism, comprising a tank body, a first piston, a fixation rod to assemble the first piston, a main energy-storage spring and a drainage valve; the first piston is assembled inside the tank body and divided the tank body into a top tank and a bottom tank; the bottom tank is a water storage room spaced by the first piston and the tank body at the lower portion of the tank body; the main energy-storage spring is attached to the first piston to generate a force to push the first piston to the bottom tank; an inlet pipe is connected to the bottom tank; wherein the bottom surface of the bottom tank is disposed with an assembly hole of the drainage valve, the drainage valve is connected to the assembly hole and assembled to the outer side of the bottom tank, the drainage valve is disposed with at least a drainage hole to connect to a flush pipe; the drainage valve is connected to a draining control component, the draining control component is configured to control the on-off of the drainage valve.

In another preferred embodiment, the drainage valve comprises a main body, a waterseal element and a draining piston; the main body is a hollow structure with an inlet and an outlet, the waterseal element is disposed above the inlet of the drainage valve, forming a sealing mechanism with the inlet of the main body; the draining piston is disposed below the inlet of the drainage valve, a back-pressure cavity is formed below the draining piston inside the main body; the draining control component is capable of connecting the back-pressure cavity and the bottom tank to let the water of the bottom tank in that the draining piston with a push rod moves up and pushes the waterseal element to open the drainage valve.

In another preferred embodiment, the main body of the drainage valve is column structural, the axis of the waterseal element and the draining piston are parallel to the axis or the generatrix of the main body of the drainage valve.

In another preferred embodiment, the waterseal element is disposed with a linkage rod in the moving direction, the linkage rod is disposed with shaft ring, the draining piston drives the waterseal element to move in the axis direction.

In another preferred embodiment, the waterseal element is connected to the main body of the drainage valve or the bottom tank via a rotation shaft or a rib, the draining piston drives the waterseal element to overturn.

In another preferred embodiment, the main body of the drainage valve is disposed with a funnel-shaped limit guiding groove extending inwardly; the push rod of the draining piston is sleeved in the limit guiding groove; when the draining piston moves up and contacts with the limit guiding groove, the draining piston stops moving up.

In another preferred embodiment, a draining spring is disposed between the waterseal element and the main body of the drainage valve, the draining spring enforces the waterseal element constantly to make the waterseal element treading to open.

In another preferred embodiment, a reposition component is disposed between the draining piston and the main body of the drainage valve, when the draining piston moves up, the reposition component is pulled or compressed to enforce the draining piston to reposition.

In another preferred embodiment, the draining control component comprises an inlet pipe of back-pressure cavity and a draining sealing element, one end of the inlet pipe of the back-pressure cavity is connected to the back-pressure cavity of the drainage valve, the other end is connected to the pressure water source; the draining sealing element is assembled to the inlet pipe of the back-pressure cavity at the connection end of the inlet pipe of the back-pressure cavity and the pressure water source to control to open the pressure water source.

In another preferred embodiment, the bottom tank is disposed with a joint of pressure water source, the inlet pipe of the back-pressure cavity is connected to the bottom tank via the joint of the pressure water source.

In another preferred embodiment, the draining piston is disposed with a decompression hole to connect the back-pressure cavity and the outlet of the drainage valve.

A toilet assembled with any of above draining and flushing mechanisms.

In another preferred embodiment, the drainage valve of the draining and flushing mechanism is connected with a flush pipe, a vacuum breaker is disposed between the flush pipe and the toilet.

The present invention has advantages as below:

1. with above technical proposal, the drainage valve can be assembled not in the axial line but in the outer side of the water tank, so that it is more convenient to assemble or maintain the drainage valve, and the size of the flushing mechanism can be reduced.
2. it can be configured with two small size flushing mechanisms at the two sides of the S pipe of the rear portion of the toilet, so that the toilet can be reduced in size, it thus expands the design availability of the whole toilet.
3. When a toilet is applied with the draining and flushing mechanism, the washing hole to wash the surface and the jet hole of the toilet can be applied with different flushing mechanism, so that it can effectively work with flushing and ensure the flushing of the toilet and it is more water saving.

Figure 1:
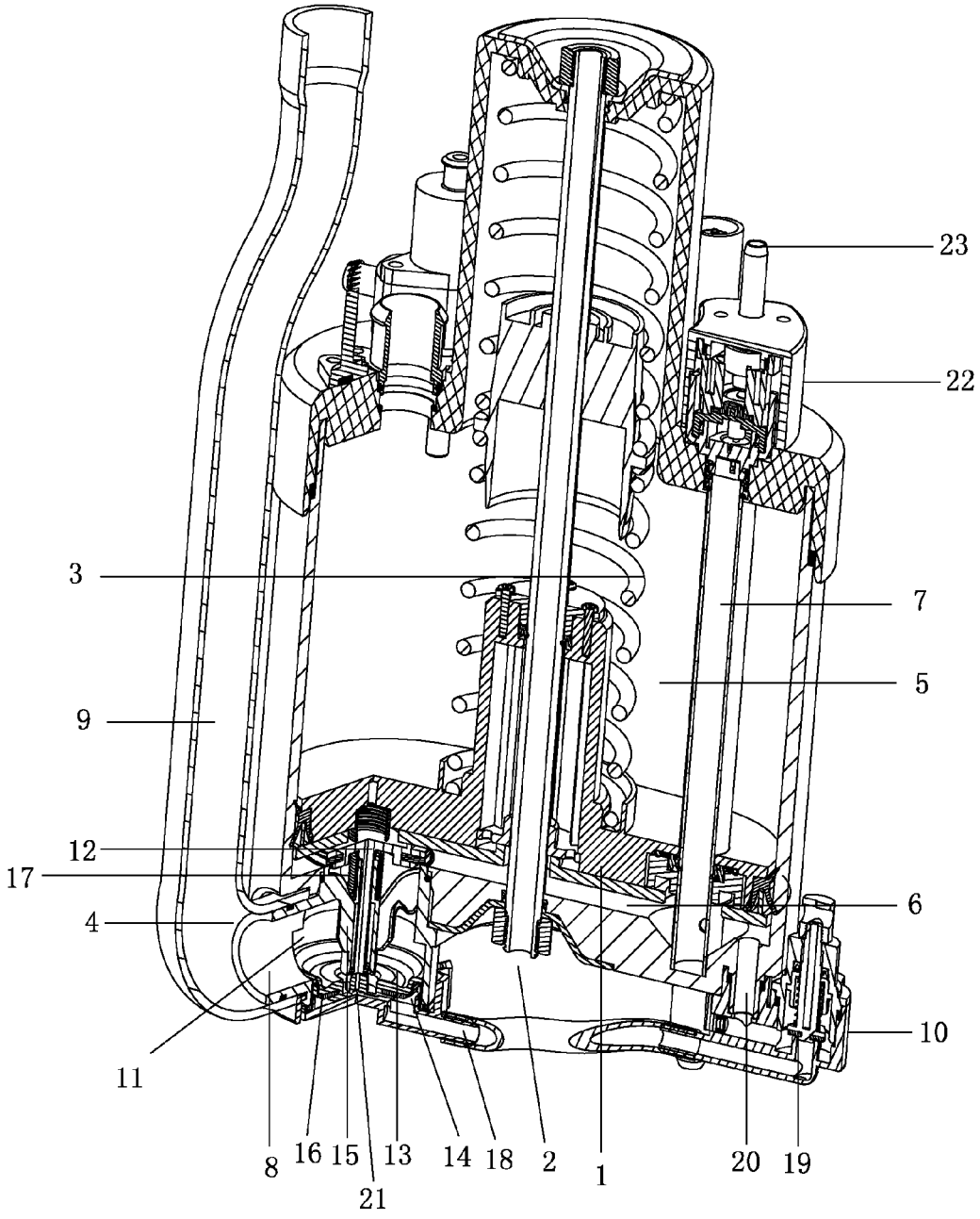
FIG. 1 illustrates a sectional and schematic diagram of the whole structure of the first embodiment of the present invention.

Reference signs: the first piston 1, the fixation rod 2, the main energy-storage spring, the drainage valve 4, the top tank 5, the bottom tank 6, the inlet pipe 7, the drainage hole 8, the flushing pipe 9, the draining control component 10, the drainage valve main body 11, the waterseal element 12, the draining piston 13, the back-pressure cavity 14, the limit guiding groove 15, the reposition component 16, the draining spring 17, the backpressure cavity inlet pipe 18, the draining sealing element 19, the pressure water source joint 20, the decompression hole 21, the on-off control component 22, the water feeding passage 23, the travel switch 24, the travel switch reposition spring 25, the inlet joint 26, the waterseal element reposition component 27, the draining and flushing mechanism 28, the vacuum breaker 29, the toilet 30.

DETAILED DESCRIPTION OF THE EMBODIMENTS

The present invention will be further described with the drawings and the embodiments.

The First Embodiment

Figure 2:
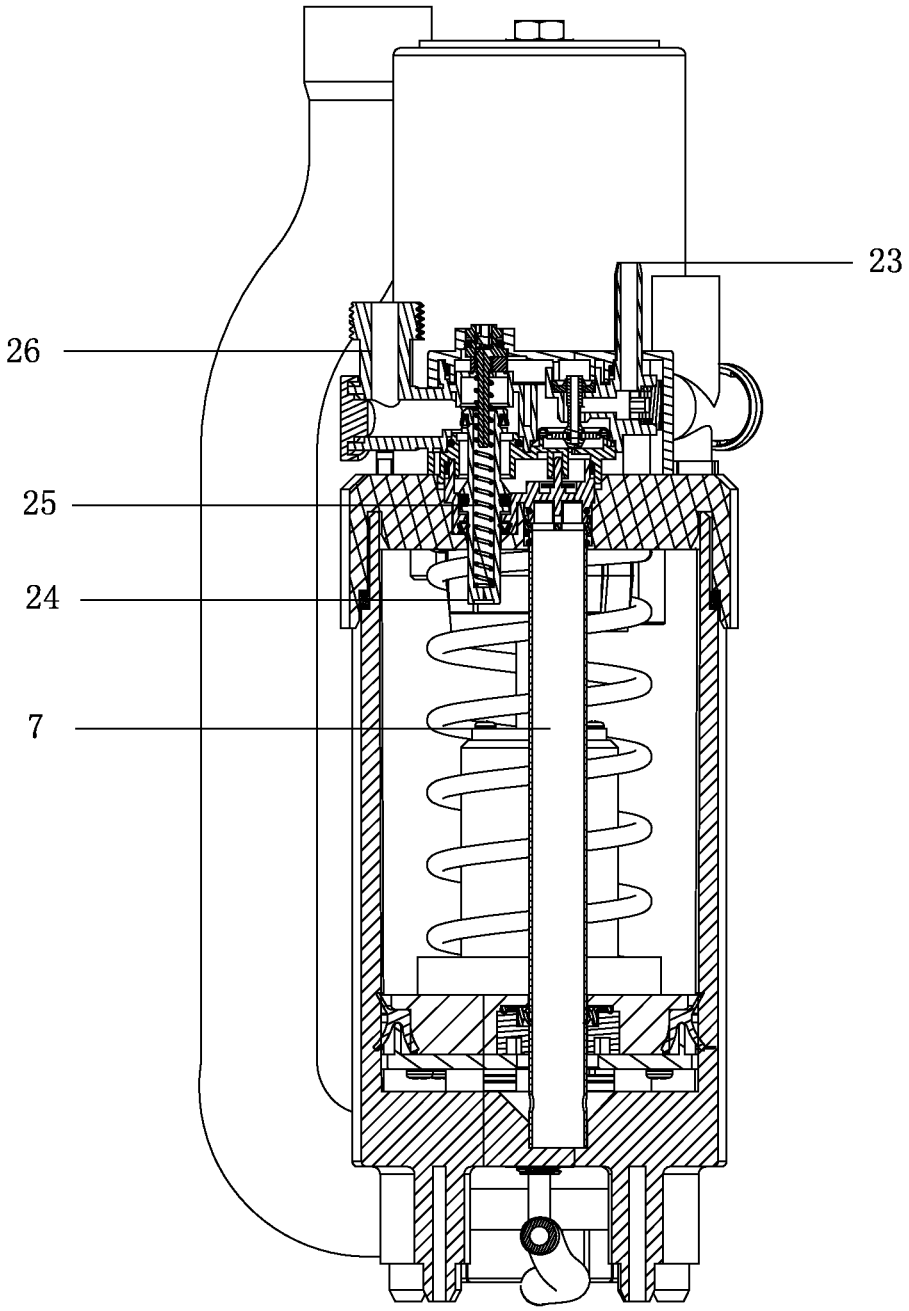
FIG. 2 illustrates a side and sectional diagram of the whole structure of the first embodiment of the present invention.

As figured in FIG. 1 and FIG. 2, a draining and flushing mechanism comprises a tank body, a first piston 1, a fixation rod 2 to assemble the first piston 1, a main energy-storage spring 3 and a drainage valve 4; the first piston 1 is assembled inside the tank body and divided the tank body to a top tank 5 and the bottom tank 6; the bottom tank is a water storage room spaced by the first piston 1 and the tank body at the lower portion of the tank body; the main energy-storage spring 3 is attached to the first piston 1 to generate a force to push the first piston 1 to the bottom tank 6; the main energy-storage spring 3 stores energy when it is compressed or pulled when water enters, and it makes the first piston 1 moving down to drain water. An inlet pipe 7 runs through the first piston 1 and is connected to the bottom tank 6; the bottom surface of the bottom tank 6 is disposed with an assembly hole of the drainage valve 4, the drainage valve 4 is attached to the outer side of the bottom tank 6 via the assembly hole of the drainage valve, the drainage valve 4 is disposed with at least a drainage hole 8 to connect to a flush pipe 9; the drainage valve 4 is connected to the draining control component 10 to control the on-off of the drainage valve 4.

The drainage valve 4 comprises a main body 11, a waterseal element 12 and a draining piston 13; the main body 11 is a hollow structure with an inlet and an outlet, the waterseal element 12 is disposed above the inlet of the drainage valve 4, forming a sealing mechanism when contacted with the inlet of the main body 11; the draining piston 13 is disposed below the inlet of the drainage valve 4, a back-pressure cavity 14 is formed below the draining piston 13 inside the main body 11; the draining piston 13 is disposed with a push rod to push the waterseal element 12. The main body 11 of the drainage valve is column structural, the axis of the waterseal element 12 and the draining piston 13 are parallel to the axis or the generatrix of the main body 11 of the drainage valve.

The draining control component 10 comprises an inlet pipe 18 of back-pressure cavity and a draining sealing element 19, one end of the inlet pipe 18 of the back-pressure cavity is connected to the back-pressure cavity 14 of the drainage valve, the other end is connected to the pressure water source; the draining sealing element 19 is assembled to draining control component 10 at the connection end of the inlet pipe 18 of the back-pressure cavity and the pressure water source to control to open the pressure water source. When the draining control component 10 is open, the control hole of the drainage valve 4 is connected to the water tank or the pressure water source at the outer side, thus opening the drainage valve 4.

The draining piston 13 is disposed with a decompression hole 21 to connect the backpressure cavity 14 and the drainage valve 4.

As figured in FIG. 1 and FIG. 2, the water source is connected to an inlet joint 26 of the on-off control component 22. Some water flows to the water feeding passage 23 of the on-off control component. The toilet is watered via a water feeding pipe, the rest of the water flows to the bottom tank 6 though the internal cavity of the on-off control component via the inlet pipe 7.

When used at the first time, the inlet of the drainage valve is closed. At this time, the water pressure works on the waterseal element 12 of the drainage valve 4, the waterseal element 12 closed the inlet of the drainage valve 4, so that water is stopped inside the tank body. Under the work of the water pressure, the first piston 1 overcomes the pressure of the main energy-storage spring 3 and moves up. When the first piston 1 moves to a preset position, it pushes the travel switch 24 of the on-off control component 22 to close the inlet passage of the on-off control component 22, the flushing mechanism stops water inlet. At this time, the spring stores energy, the inner side of the water tank stores pressure water for later use.

To drain water, open the draining control component 10, in this embodiment, the draining control component 10 is operated by pulling a pull. The draining control component can be applied with other valves to control the on-off of the water. The pressure water of the water tank flows to the backpressure cavity 14 of the drainage valve 4 via the passage inside the draining control component 10. As the decompression hole 21 of the backpressure cavity 14 is small, the water pressures are basically the same in the backpressure cavity 14 and the water tank. The pressures at the two sides of the draining piston 13 are different, so that the draining piston 13 trends to move up. Under the work of the draining piston 13 and the draining spring 17, the waterseal element 12 is open to the maximum height. As a limit mechanism is disposed between the waterseal element 12 and the drainage valve 4, the waterseal element 12 can not leave away from the drainage valve 4. The flushing mechanism drains water in high speed. In this embodiment, the limit mechanism is a shaft ring, others like lock catch or a screw with a larger head are available.

The first piston 1 moves down, when it moves to a preset position, it leaves away from the travel switch 24 of the on-off control component 22, the travel switch 24 repositions under the push of the reposition spring 25, external water enters to the water tank. As inlet volume is smaller than the draining volume, the first piston 1 keeps moving down.

When the draining control component 10 is closed, under the work of the reposition component 16 (in this embodiment, the reposition component 16 is a rubber element), water of the backpressure cavity 14 of the drainage valve squeezes out, the draining piston 13 repositions. When the first piston 1 moves down to contact with the waterseal element 12, the first piston 1 and the waterseal element 12 move down synchronously until the waterseal element 12 closes the inlet of the drainage valve 4. After that, under the work of the water pressure, the first piston 1 changes the moving direction and moves up. When the first piston 1 moves to a preset position, it pushes the travel switch 24 of the on-off control component 22 to close the inlet passage of the on-off control component 22, the flushing mechanism stops water inlet. At this time, the main spring stores energy, the inner side of the water tank stores pressure water for later use.

As can be seen from above, it is the process of a working cycle of the flushing mechanism.

The Second Embodiment

This embodiment has different drainage valve 4 from the first embodiment, the other is basically the same.

Figure 3:
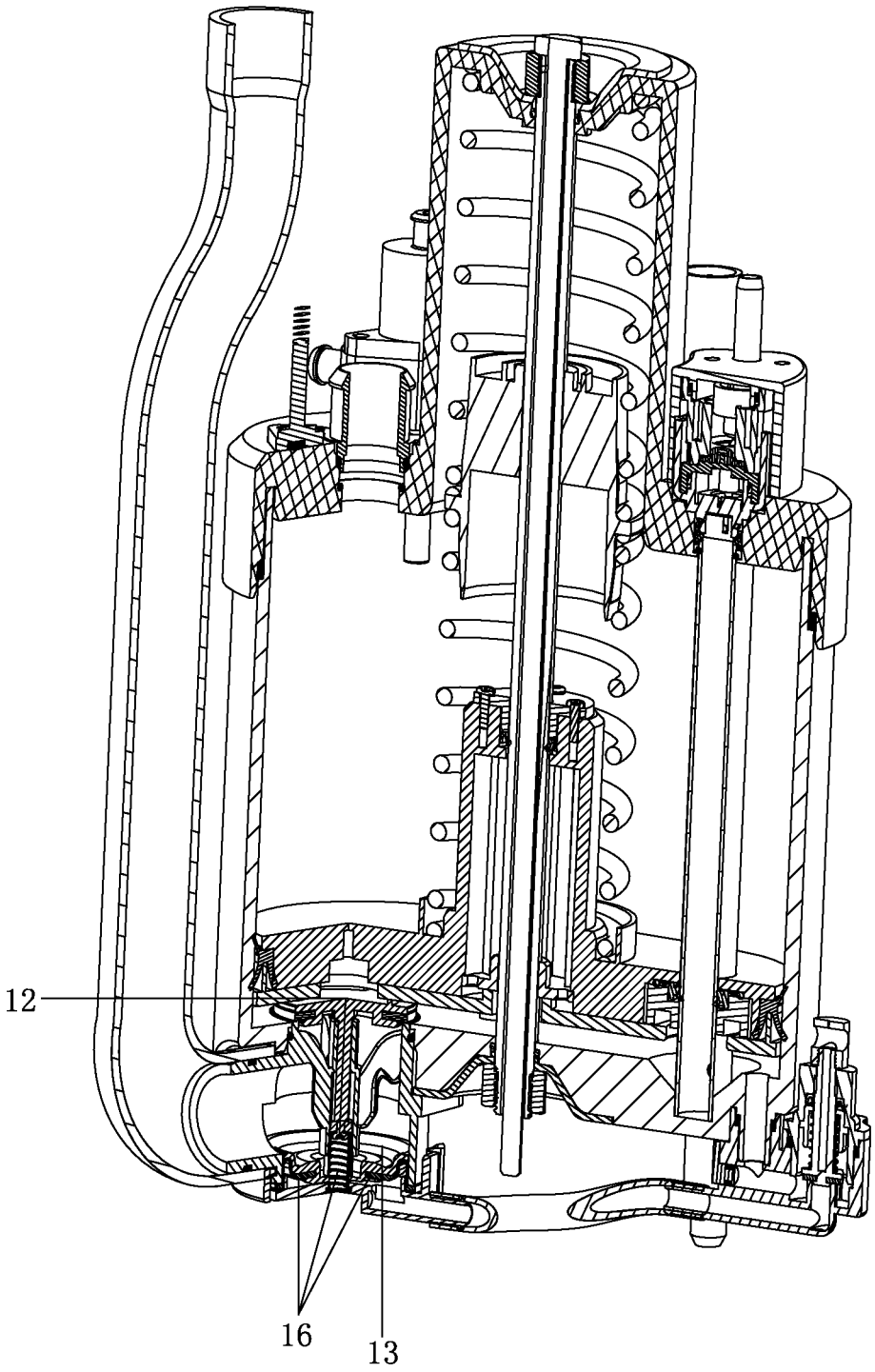
FIG. 3 illustrates a sectional view of the drainage valve of the second embodiment of the present invention.
Figure 4:
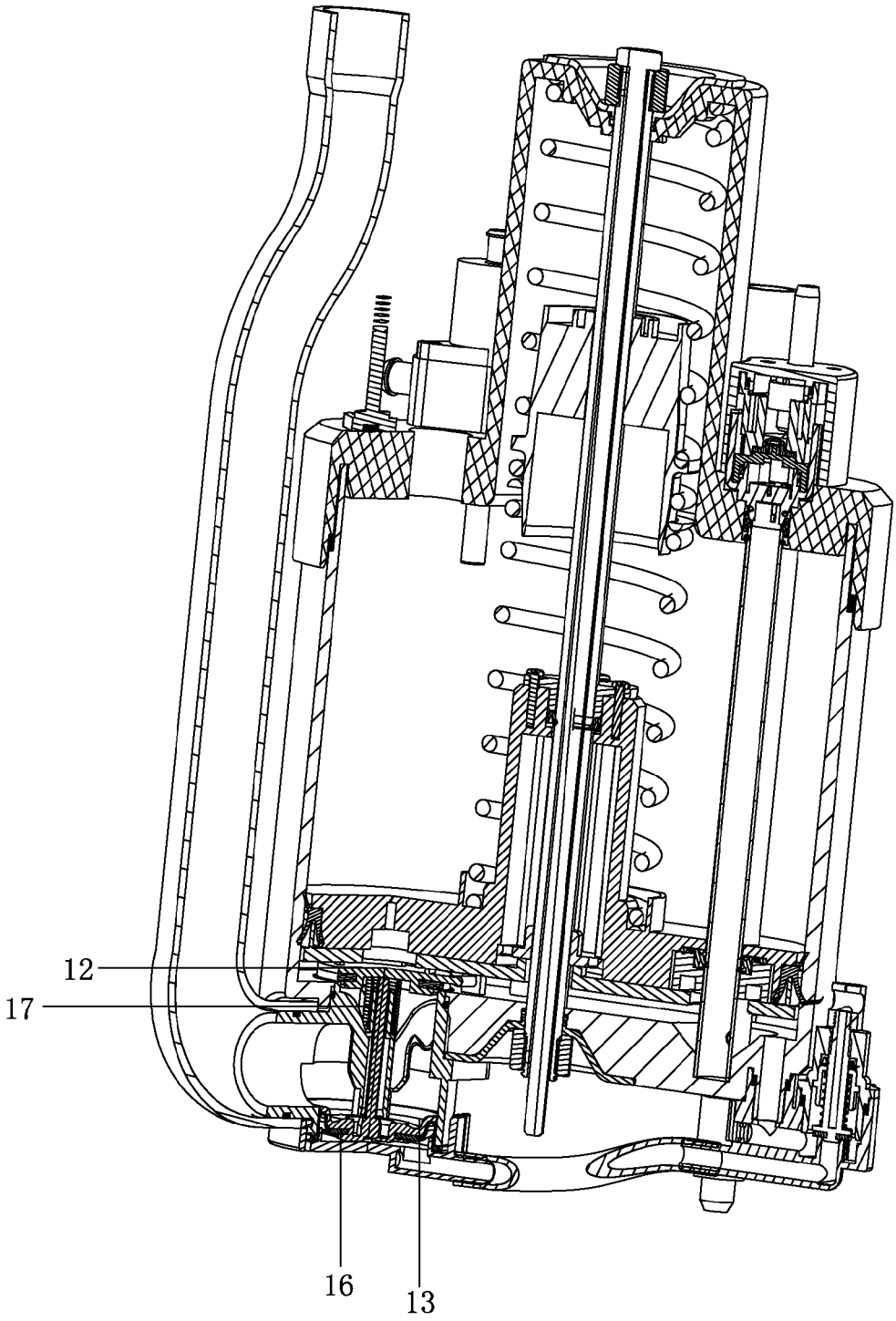
FIG. 4 illustrates a sectional view of the drainage valve of the third embodiment of the present invention in the initial water inlet state.
Figure 5:
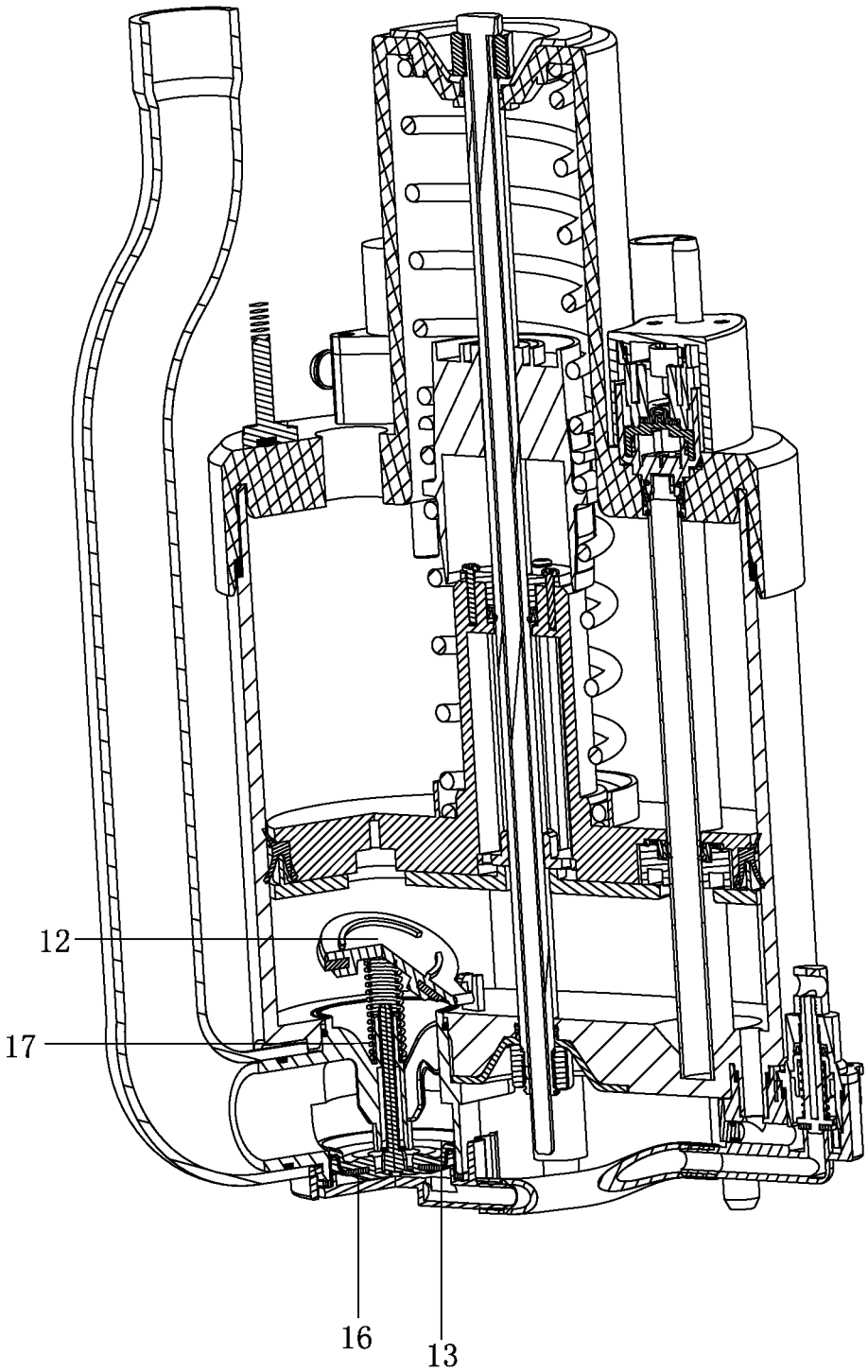
FIG. 5 illustrates a sectional view of the drainage valve of the third embodiment of the present invention in draining water state.

As figured in FIG. 1, FIG. 2 and FIG. 3, the external water source is connected to the inlet joint 26 of the on-off control component 22. some water flows to the water feeding pipe to feed water to the toilet via the water feeding passage 23 of the on-off control component 22, the rest water flows to the bottom tank 6 through the inner cavity of the on-off control component 22 via the inlet guiding pipe.

When used at the first time, the inlet of the drainage valve 4 is closed. At this time, the water pressure works on the waterseal element 12 of the drainage valve 4, the waterseal element 12 closed the inlet of the drainage valve 4, so that water is kept inside the tank body. Under the work of the water pressure, the first piston 1 overcomes the pressure of the main energy-storage spring 3 and moves up. When the first piston 1 moves to a preset position, it pushes the travel switch 24 of the on-off control component 22 to close the inlet passage of the on-off control component 22, the flushing mechanism stops water inlet. At this time, the spring stores energy, the inner side of the water tank stores pressure water for later use.

To drain water, open the draining control component 10, the pressure water of the water tank flows to the backpressure cavity 14 of the drainage valve 4 via the passage inside the draining control component 10. As the decompression hole 21 of the backpressure cavity 14 is small, the water pressures are basically the same in the backpressure cavity 14 and the water tank. As the area of the draining piston 13 is larger than the area of the inlet of the inlet valve, under the work of the water pressure, the draining piston 13 moves up to push the waterseal element 12. the flushing water drains water.

The first piston 1 moves down, when it moves to a preset position, it leaves away from the travel switch 24 of the on-off control component 22, the travel switch 24 repositions under the push of the reposition spring 25, external water enters to the water tank. As the drainage valve 3 is open, the inlet volume is smaller than the draining volume, the first piston 1 keeps moving down.

When the draining control component 10 is closed, the pressure of the backpressure cavity 14 of the drainage valve reduces, the draining piston 13 trends to reposition. Preferred, under the work of the reposition component 16 (in this embodiment, the reposition component 16 is an extension spring and an elastic rubber element), water of the backpressure cavity 14 of the drainage valve drains out, the draining piston 13 repositions. Then the waterseal element 12 moves down to close the inlet of the drainage valve under the work of the water pressure. After the inlet of the drainage valve 4 is closed, the first piston 1 changes to move up under the work of the water pressure. When the first piston 1 moves to a preset position, it pushes the travel switch 24 of the on-off control component 22 to close the inlet passage of the on-off control component 22, the flushing mechanism stops water inlet. At this time, the main spring stores energy, the inner side of the water tank stores pressure water for later use.

That is a working cycle of the flushing mechanism.

The Third Embodiment

The waterseal element 12 in this embodiment is different from the first embodiment, the other is basically the same. (the waterseal element 12 rotates about a fixation shaft).

As figured in FIG. 1, FIG. 2, FIG. 4 and FIG. 5, the external water source is connected to the inlet joint 26 of the on-off control component 22. Some water flows to the water feeding pipe to feed water to the toilet via the water feeding passage 23 of the on-off control component 22, the rest water flows to the bottom tank 6 through the inner cavity of the on-off control component 22 via the inlet guiding pipe.

When used at the first time, the inlet of the drainage valve 4 is closed. At this time, the water pressure works on the waterseal element 12 of the drainage valve 4, the waterseal element 12 closes the inlet of the drainage valve 4, so that water is kept inside the tank body. Under the work of the water pressure, the first piston 1 overcomes the pressure of the main energy-storage spring 3 and moves up. When the first piston 1 moves to a preset position, it pushes the travel switch 24 of the on-off control component 22 to close the inlet passage of the on-off control component 22, the flushing mechanism stops water inlet. At this time, the spring stores energy, the inner side of the water tank stores pressure water for later use.

To drain water, open the draining control component 10, the pressure water of the water tank flows to the backpressure cavity 14 of the drainage valve 4 via the passage inside the draining control component 10. As the decompression hole 21 of the backpressure cavity 14 is small, the water pressures are basically the same in the backpressure cavity 14 and the water tank. The pressures at the two sides of the draining piston 13 are different, so that the draining piston 13 trends to move up. As figured in FIG. 4 and FIG. 5, under the work of the draining piston 13 and the draining spring 17 (preferred with the draining spring 17), the waterseal element 12 rotates and overturns about an axis, the flushing mechanism drains water. Under the work of the draining spring 17, the waterseal element 12 opens to a maximum angle. As a limit mechanism is disposed between the waterseal element 12 and the bottom tank 6 (or the main body 11 of the drainage valve), the waterseal element 12 overturns to a preset maximum angle (for example 5-89 degrees). The flushing mechanism drains water in high speed. The limit mechanism here can be a rib or the same structure disposed near the rotation hole of the bottom tank.

The first piston 1 moves down, when it moves to a preset position, it leaves away from the travel switch 24 of the on-off control component 22, the travel switch 24 repositions under the push of the reposition spring 25, external water enters to the water tank. As the drainage valve 3 is open, the inlet volume is smaller than the draining volume, the first piston 1 keeps moving down.

When the draining control component 10 is closed, under the work of the reposition component 16 (in this embodiment, the reposition component 16 is a rubber element), water of the backpressure cavity 14 of the drainage valve drains out, the draining piston 13 repositions. When the first piston 1 moves down to contact with the waterseal element 12, the first piston 1 pushes the waterseal element 12 to rotate about the axis until the waterseal element 12 closes the inlet of the drainage valve. After that, under the work of the water pressure, the first piston 1 changes the moving direction and moves up. When the first piston 1 moves to a preset position, it pushes the travel switch 24 of the on-off control component 22 to close the inlet passage of the on-off control component 22, the flushing mechanism stops water inlet. At this time, the main spring stores energy, the inner side of the water tank stores pressure water for later use.

That is a working cycle of the flushing mechanism.

The Fourth Embodiment

The drainage valve 4 in this embodiment is different from the second embodiment, the other is basically the same.

Figure 6:
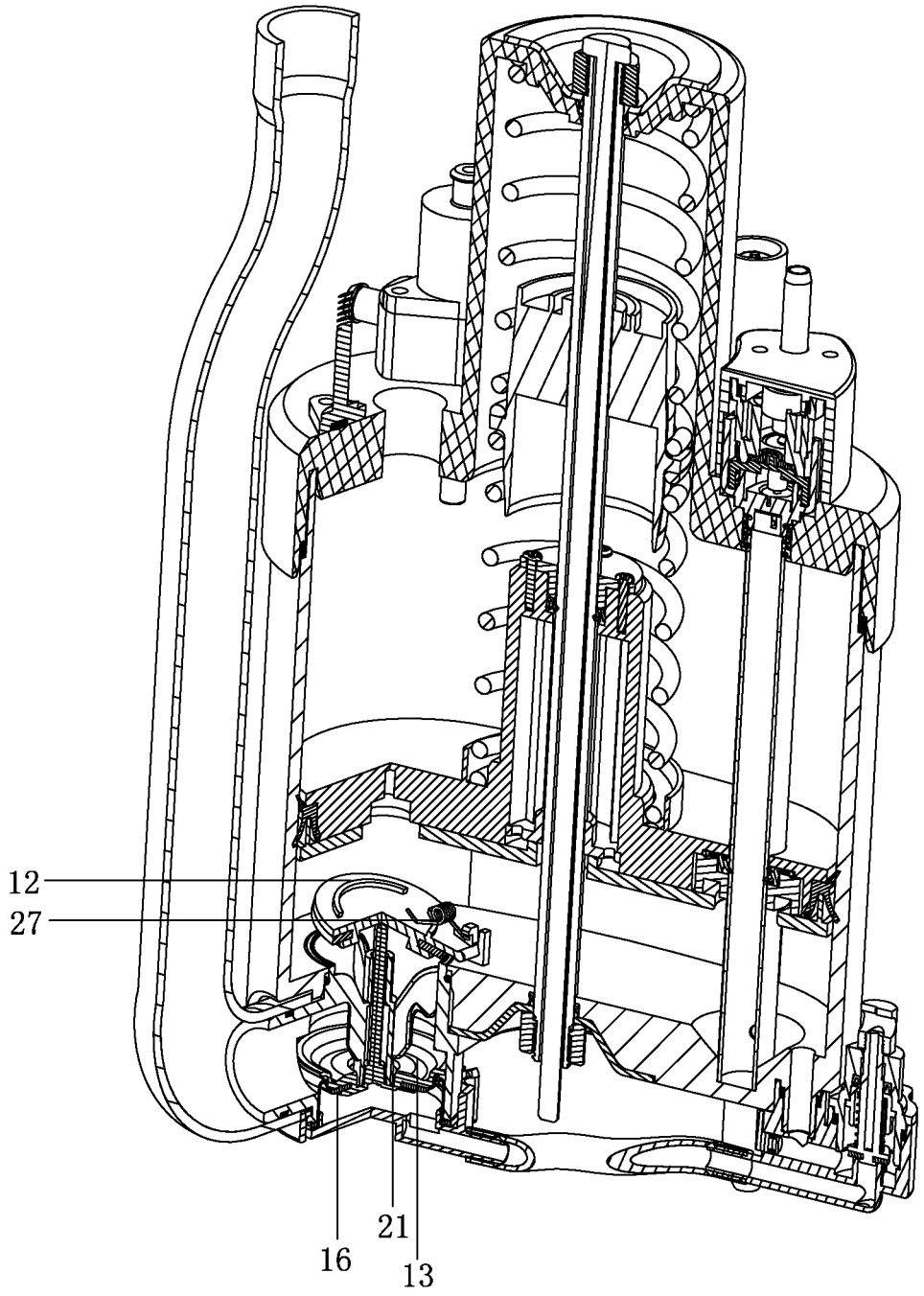
FIG. 6 illustrates a sectional view of the drainage valve of the fourth embodiment of the present invention in draining water state.

As figured in FIG. 1, FIG. 2 and FIG. 6, the external water source is connected to the inlet joint 26 of the on-off control component 22. Some water flows to the water feeding pipe to feed water to the toilet via the water feeding passage 23 of the on-off control component 22, the rest water flows to the bottom tank 6 through the inner cavity of the on-off control component 22 via the inlet guiding pipe.

When used at the first time, the inlet of the drainage valve 4 is closed. At this time, the water pressure works on the waterseal element 12 of the drainage valve 4, the waterseal element 12 closes the inlet of the drainage valve 4, so that water is kept inside the tank body. Under the work of the water pressure, the first piston 1 overcomes the pressure of the main energy-storage spring 3 and moves up. When the first piston 1 moves to a preset position, it pushes the travel switch 24 of the on-off control component 22 to close the inlet passage of the on-off control component 22, the flushing mechanism stops water inlet. At this time, the spring stores energy, the inner side of the water tank stores pressure water for later use.

To drain water, open the draining control component 10, the pressure water of the water tank flows to the backpressure cavity 14 of the drainage valve 4 via the passage inside the draining control component 10. As the decompression hole 21 of the backpressure cavity 14 is small, the water pressures are basically the same in the backpressure cavity 14 and the water tank. As the area of the draining piston 13 is lager than the area of the inlet of the inlet valve, under the work of the water pressure, the draining piston 13 moves up to push the waterseal element 12. The flushing water drains water.

The first piston 1 moves down, when it moves to a preset position, it leaves away from the travel switch 24 of the on-off control component 22, the travel switch 24 repositions under the push of the reposition spring 25, external water enters to the water tank. As the drainage valve 3 is open, the inlet volume is smaller than the draining volume, the first piston 1 keeps moving down.

When the draining control component 10 is closed, as figured in FIG. 6, the pressure of the backpressure cavity 14 of the drainage valve reduces, the pressures at the two sides of the draining piston are different. Preferred, under the work of the reposition component 16 (in this embodiment, the reposition component 16 is a rubber element) and the pressure difference, the draining piston 13 repositions. In this embodiment, a reposition component 27 is configured to close the waterseal element. The waterseal element 12 moves with the draining piston until the inlet of the drainage valve is closed under the work of the reposition component 27 and the water pressure. In this embodiment, the reposition component 27 is a torsion spring or an elastic rubber element assembled in the top surface of the waterseal element 12. After the inlet of the drainage valve 4 is closed, the first piston 1 changes to move up under the work of the water pressure. When the first piston 1 moves to a preset position, it pushes the travel switch 24 of the on-off control component 22 to close the inlet passage of the on-off control component 22, the flushing mechanism stops water inlet. At this time, the main spring stores energy, the inner side of the water tank stores pressure water for later use.

The travel switch 24 is not necessary in above embodiments. The inlet pipe can be directly connected to the water source. When the first piston 1 moves to the preset position, it stops moving. The inner pressure of the bottom tank is the same with the water source, the flushing mechanism stops draining water. During draining, once the first piston 1 leaves the preset position, the flushing water starts water inlet. The inlet volume of the flushing mechanism is smaller than the drain volume. The flushing mechanism has same other components expect the travel switch 24 as above embodiments.

Figure 7:
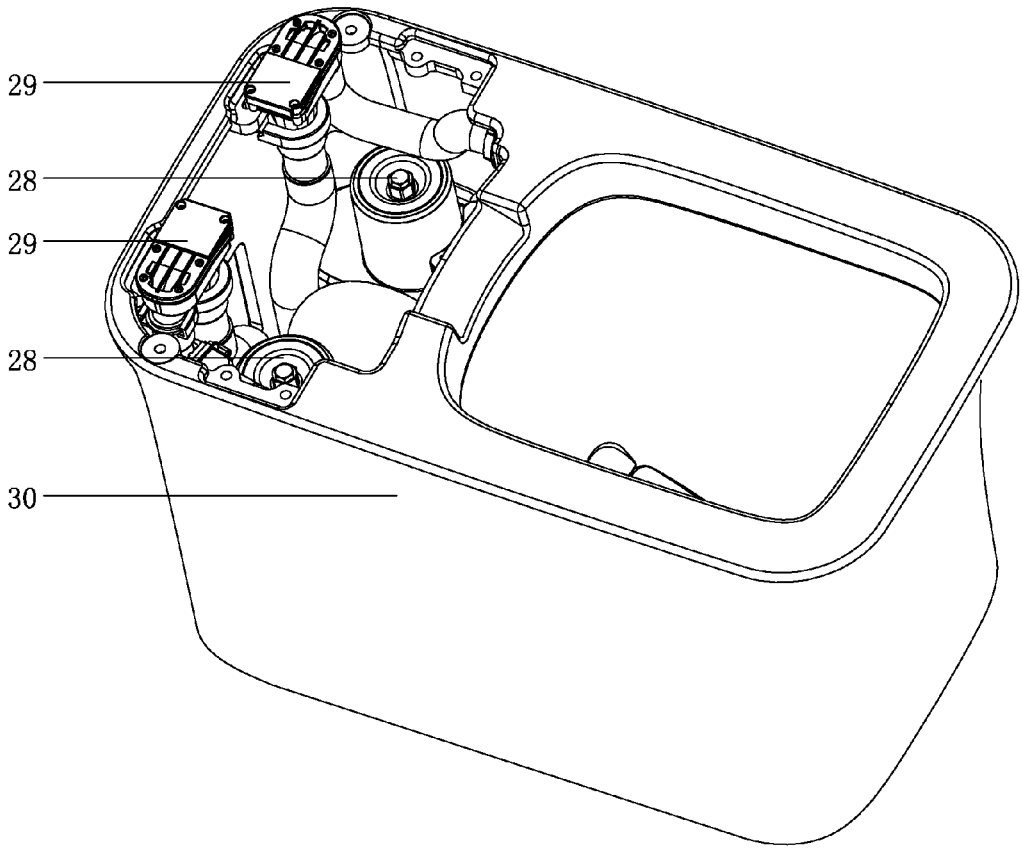
FIG. 7 illustrates a schematic diagram of the present invention applied in a toilet.

The draining and flushing mechanism can be applied in a toilet, so that a toilet is provided with any of above draining and flushing mechanism. As figured in FIG. 7, the drainage valve 4 of the draining and flushing mechanism 28 is connected with a flushing pipe 9, a vacuum breaker 29 is disposed between the flushing pipe 9 and the toilet 30. the vacuum breaker 29 is used to prevent dirt water polluting the water supply pipe when negative pressure happens in the water supply pipe.

When a jet and siphon toilet is applied with two above draining and flushing mechanism, the washing hole to wash the surface and the jet hole of the toilet can be applied with different flushing mechanisms to supply flushing water. So that it can effectively control the flushing water proportion of the washing hole and the jet hole and ensure the pressures. Thus it is benefit to improve and ensure the flushing performance of a toilet.

INDUSTRIAL APPLICABILITY

The present invention is provided that the drainage valve thereof can be assembled not in the central axis line but assembled at the outer side of the water tank individually, thus making it more convenient to assemble and maintain the drainage valve, the flushing mechanism can be configured with small size as well.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A draining and flushing mechanism, comprising a tank body, a first piston, a fixation rod to assemble the first piston, a main energy-storage spring and a drainage valve; the first piston is assembled inside the tank body and divided the tank body into a top tank and a bottom tank; the bottom tank is a water storage room spaced by the first piston and the tank body at the lower portion of the tank body; the main energy-storage spring is attached to the first piston to generate a force to push the first piston to the bottom tank; an inlet pipe is connected to the bottom tank; wherein the bottom surface of the bottom tank is disposed with an assembly hole of the drainage valve, the drainage valve is connected to the assembly hole and assembled to the outer side of the bottom tank, the drainage valve is disposed with at least a drainage hole to connect to a flush pipe; the drainage valve is connected to a draining control component, the draining control component is configured to control the on-off of the drainage valve.

2. The draining and flushing mechanism according to claim 1, the drainage valve comprises a main body, a waterseal element and a draining piston; the main body is a hollow structure with an inlet and an outlet, the waterseal element is disposed above the inlet of the drainage valve, forming a sealing mechanism with the inlet of the main body; the draining piston is disposed below the inlet of the drainage valve, a back-pressure cavity is formed below the draining piston inside the main body; the draining control component is capable of connecting the back-pressure cavity and the bottom tank to let the water of the bottom tank in that the draining piston with a push rod moves up and pushes the waterseal element to open the drainage valve.

3. The draining and flushing mechanism according to claim 2, wherein the main body of the drainage valve is column structural, the axis of the waterseal element and the draining piston are parallel to the axis or the generatrix of the main body of the drainage valve.

4. The draining and flushing mechanism according to claim 3, wherein the waterseal element is disposed with a linkage rod in the moving direction, the linkage rod is disposed with shaft ring, the draining piston drives the waterseal element to move in the axis direction.

5. The draining and flushing mechanism according to claim 3, wherein the waterseal element is connected to the main body of the drainage valve or the bottom tank via a rotation shaft or a rib, the draining piston drives the waterseal element to overturn.

6. The draining and flushing mechanism according to claim 2, wherein the main body of the drainage valve is disposed with a funnel-shaped limit guiding groove extending inwardly; the push rod of the draining piston is sleeved in the limit guiding groove; when the draining piston moves up and contacts with the limit guiding groove, the draining piston stops moving up.

7. The draining and flushing mechanism according to claim 2, wherein a draining spring is disposed between the waterseal element and the main body of the drainage valve, the draining spring enforces the waterseal element constantly to make the waterseal element treading to open.

8. The draining and flushing mechanism according to claim 2, wherein a reposition component is disposed between the draining piston and the main body of the drainage valve or in the draining piston, when the draining piston moves up, the reposition component is pulled or compressed to enforce the draining piston to reposition.

9. The draining and flushing mechanism according to claim 2, wherein the draining control component comprises an inlet pipe of back-pressure cavity and a draining sealing element, one end of the inlet pipe of the back-pressure cavity is connected to the back-pressure cavity of the drainage valve, the other end is connected to the pressure water source; the draining sealing element is assembled to the inlet pipe of the back-pressure cavity at the connection end of the inlet pipe of the back-pressure cavity and the pressure water source to control to open the pressure water source.

10. The draining and flushing mechanism according to claim 9, wherein the bottom tank is disposed with a joint of pressure water source, the inlet pipe of the back-pressure cavity is connected to the bottom tank via the joint of the pressure water source.

11. The draining and flushing mechanism according to claim 9, wherein the draining piston is disposed with a decompression hole to connect the back-pressure cavity and the outlet of the drainage valve.

12. A toilet, wherein the toilet is assembled with the draining and flushing mechanism according to claim 1.

13. The toilet according to claim 12, wherein the drainage valve of the draining and flushing mechanism is connected with a flush pipe, a vacuum breaker is disposed between the flush pipe and the toilet.

* * * * *